US011186081B2

(12) United States Patent
Anderson et al.

(10) Patent No.: US 11,186,081 B2
(45) Date of Patent: Nov. 30, 2021

(54) CURRENT LEAKAGE TEST OF A FLUID EJECTION DIE

(71) Applicant: HEWLETT-PACKARD DEVELOPMENT COMPANY, L.P., Fort Collins, CO (US)

(72) Inventors: Daryl E Anderson, Corvallis, OR (US); Eric Martin, Corvallis, OR (US); James Michael Gardner, Corvallis, OR (US); Rogelio Cicili, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 420 days.

(21) Appl. No.: 16/317,891

(22) PCT Filed: Oct. 24, 2016

(86) PCT No.: PCT/US2016/058479
§ 371 (c)(1),
(2) Date: Jan. 15, 2019

(87) PCT Pub. No.: WO2018/080426
PCT Pub. Date: May 3, 2018

(65) Prior Publication Data

US 2021/0276321 A1 Sep. 9, 2021

(51) Int. Cl.
*B41J 2/045* (2006.01)

(52) U.S. Cl.
CPC ..... *B41J 2/0451* (2013.01); *B41J 2/0458* (2013.01); *B41J 2/04581* (2013.01)

(58) Field of Classification Search
CPC ..... B41J 2/0451; B41J 2/14153
See application file for complete search history.

(56) References Cited

U.S. PATENT DOCUMENTS 6,089,700 A 7/2000 Ahn
7,645,007 B2 1/2010 Komatsu
(Continued)

FOREIGN PATENT DOCUMENTS

CN 1953870 A 4/2007
CN 102729630 10/2012
(Continued)

OTHER PUBLICATIONS

Matavz, A. et al., Inkjet printing of uniform dielectric oxide structures from sol-gel inks by adjusting the solvent composition, 2016, < http://pubs.rsc.org/en/content/articlepdf/2016/tc/c6tc01090c >.

*Primary Examiner* — Julian D Huffman
(74) *Attorney, Agent, or Firm* — Brooks, Cameron & Huebsch, PLLC

(57) ABSTRACT

Example implementations relate to current leakage testing of a fluid ejection die. For example, a fluid ejection die may include plurality of nozzles, each nozzle among the plurality of nozzles including a nozzle sensor and a fluid ejector. The plurality of nozzle sensors may comprise a first subset and a second subset, each nozzle sensor among the plurality of nozzle sensors of the first subset may be electrically coupled to a first control line by a respective switch among a first group of switches, and each nozzle sensor among the plurality of nozzle sensors of the second subset may be electrically coupled to a second control line by a respective switch among a second group of switches. The fluid ejection die may include a control circuit to perform a current leakage test of the plurality of nozzles using the first control line and the second control line.

15 Claims, 4 Drawing Sheets

(56) References Cited

U.S. PATENT DOCUMENTS

| | | | | |
|---|---|---|---|---|
| 9,283,750 | B2 | 3/2016 | Liao et al. | |
| 9,327,500 | B2 | 5/2016 | Nagatoya et al. | |
| 2008/0291233 | A1* | 11/2008 | Sheahan | B41J 2/04541 347/19 |
| 2010/0188458 | A1* | 7/2010 | Sheahan | B41J 2/04591 347/19 |
| 2012/0056954 | A1 | 3/2012 | Noboru et al. | |
| 2014/0184702 | A1 | 7/2014 | Ishida et al. | |

FOREIGN PATENT DOCUMENTS

| | | | |
|---|---|---|---|
| CN | 103895350 | | 7/2014 |
| WO | WO-2005105455 | A1 | 11/2005 |

* cited by examiner

CURRENT LEAKAGE TEST OF A FLUID EJECTION DIE

BACKGROUND

Fluid ejection systems may operate by ejecting a fluid from nozzles to form images on media and/or forming three dimensional objects, for example. In some fluid ejection systems, fluid droplets may be released from an array of nozzles in a fluid ejection die. The fluid may bond to a surface of a medium and forms graphics, text, images, and/or objects. Fluid ejection dies may include a number of fluid chambers, also known as firing chambers.

Figure 1A:
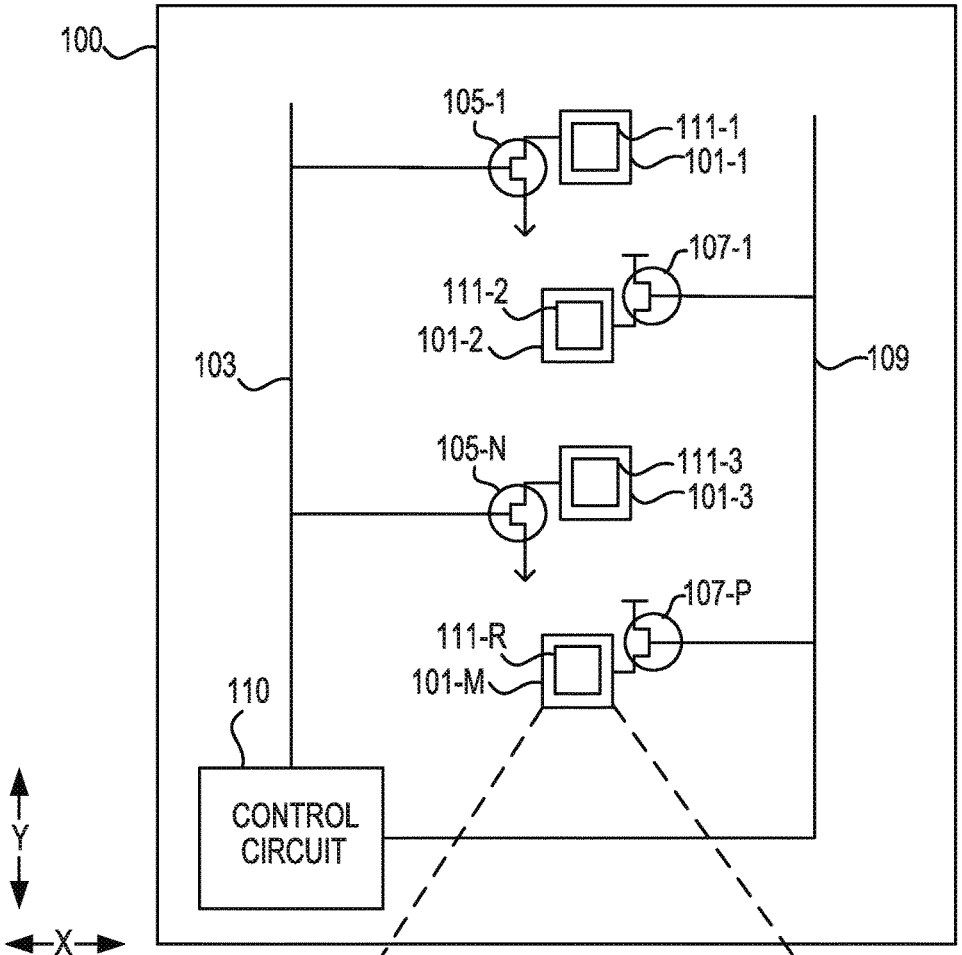
FIG. 1A illustrates a diagram of an example fluid ejection die, according to the present disclosure.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

Each fluid chamber in a fluid ejection die may be in fluid communication with a nozzle in an array of nozzles, and may provide the fluid to be deposited by that respective nozzle. Prior to a droplet release, the fluid in the fluid chamber may be restrained from exiting the nozzle due to capillary forces and/or back-pressure acting on the fluid within the nozzle passage. The meniscus, which is a surface of the fluid that separates the fluid in the chamber from the atmosphere located below the nozzle, may be held in place due to a balance of the internal pressure of the chamber, gravity, and the capillary force.

During a droplet release, fluid within the fluid chamber may be forced out of the nozzle by actively increasing the pressure within the chamber. Some fluid ejection dies may use a resistive heater positioned within the chamber to evaporate a small amount of at least one component of the fluid. The evaporated fluid component or components may expand to form a gaseous drive bubble within the fluid chamber. This expansion may exceed the restraining force enough to expel a droplet out of the nozzle. After the release of the droplet, the pressure in the fluid chamber may drop below the strength of the restraining force and the remainder of the fluid may be retained within the chamber. Meanwhile, the drive bubble may collapse and fluid from a reservoir may flow into the fluid chamber replenishing the lost fluid volume from the droplet release. This process may be repeated each time the fluid ejection die is instructed to fire. As used herein, firing of a nozzle and/or nozzles on a fluid ejection die refers to execution of a fluid ejection process. Firing of a nozzle may also be referred to as a drive bubble event.

As used herein, a drive bubble refers to a bubble formed from within a fluid chamber to dispense a droplet of fluid as part of a fluid ejection process or a servicing event. The drive bubble may be made of a vaporized fluid separated from liquid fluid by a bubble wall. The timing of the drive bubble formation may be dependent on the image and/or object to be formed.

In accordance with examples of the present disclosure, each nozzle in a fluid ejection die may have an associated nozzle sensor. These nozzle sensors may be delaminated if they are electrically connected to a circuit. These nozzle sensors may be narrowly spaced, and therefore current may leak between nozzle sensors in certain circumstances. However, conduction of electricity may compromise measurement of drive bubbles. As such, a current leakage test of a fluid ejection die, according to the present disclosure, may allow for a rapid determination of whether nozzle sensors on the fluid ejection die are electrically isolated.

Figure 1B:
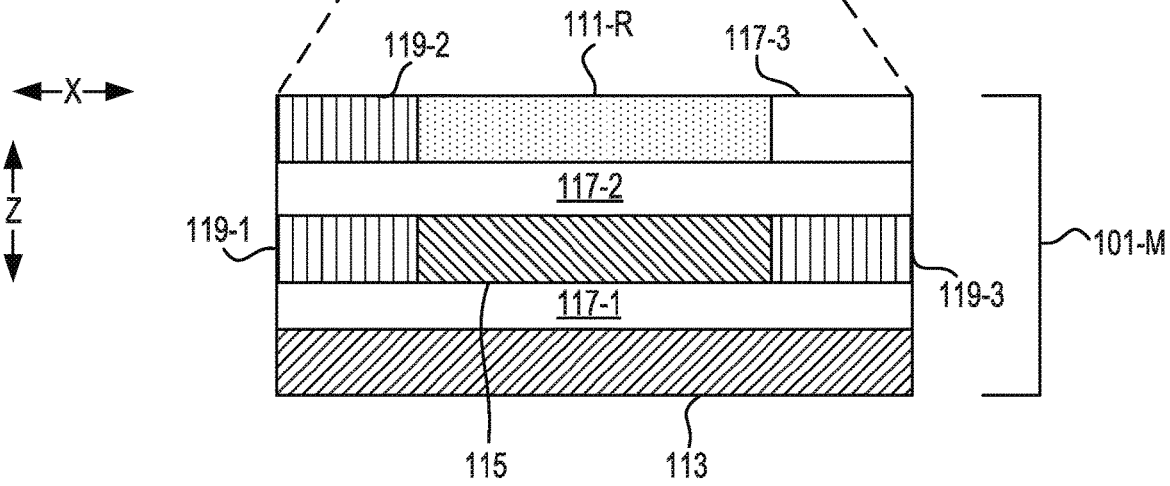
FIG. 1B illustrates a diagram of an example cross section of a nozzle, according to the present disclosure.

FIG. 1A illustrates a diagram of an example fluid ejection die 100, according to the present disclosure. As illustrated in FIG. 1A, fluid ejection die 100 may include a plurality of nozzles 101-1, 101-2, 101-3 . . . 101-M (referred to collectively as nozzles 101). Each nozzle among the plurality of nozzles 101 may include a nozzle sensor and a fluid ejector. For example, nozzle 101-1 may include nozzle sensor 111-1, nozzle 101-2 may include nozzle sensor 111-2, nozzle 101-3 may include nozzle sensor 111-3, and nozzle 101-M may include nozzle sensor 111-R. As used herein, a nozzle sensor may refer to a device and/or component that may detect the formation of a bubble in the respective nozzle. Examples of nozzle sensors may include a cavitation plate and/or a sense plate among others. The nozzle sensor may be comprised of tantalum, tantalum-aluminum, gold, and/or other materials. As used herein, a fluid ejector refers to a device and/or component that may cause ejection of a fluid responsive to application of a firing pulse. Examples of a fluid ejector may include a resistor, piezoelectric membrane, and/or other such components. For instance, FIG. 1B illustrates a diagram of a cross section of a nozzle 101-M. Referring to FIG. 1B, a top view of the fluid ejection die 100 is illustrated in the X and Y axes, while a cross section of nozzle 101-M is illustrated in the X and Z axes. While a cross section is illustrated for nozzle 101-M, it is to be understood that the same cross section may be illustrated for nozzles 101-1, 101-2, and 101-3. Nozzle 101-M may include a substrate layer 113, a fluid ejector 115, and a nozzle sensor 111-R, among other components. As described herein, the nozzle sensor may be comprised of tantalum among other components. The fluid ejector 115 may be comprised of tantalum aluminum and/or tungsten-silicon-nitride, among other examples. Examples are not so limited, however, and the fluid ejector 115 may be comprised of any resistive material that concentrates power dissipation. The nozzle sensor 111-1 may be separated from the fluid ejector 115 by dielectric 117-2. Similarly, the fluid ejector 115 may be separated from the substrate 113 by dielectric 117-1.

Nozzle 101-M may include additional components, such as metal 119-1, 119-2, and 119-3. Metal 119-1 and 119-3 may be disposed on opposite sides of fluid ejector 115. Moreover, metal 119-1 and metal 119-3 may be disposed on an opposite side of dielectric 117-1, relative to substrate 113. Similarly, metal 119-2 may be disposed on an opposite side of dielectric 117-2, relative to metal 119-1 and on an opposite side of nozzle sensor 111-R relative to dielectric 117-3. Although not illustrated in FIG. 1B, each nozzle may include a fluid chamber. For instance, nozzle 101-M may include a fluid chamber disposed on a surface of the nozzle 101-M, opposite dielectric 117-2.

The plurality of nozzle sensors 111, may be grouped into different subsets. For example, the plurality of nozzle sensors 111 may comprise a first subset including nozzle sensors 111-1 and 111-3 and a second subset including nozzle sensors 111-2 and 111-R. Each nozzle sensor among the plurality of nozzle sensors of the first subset (nozzle sensors 111-1 and 111-3) may be electrically coupled to a first control line 103 by a respective switch 105-1, 105-N (collectively referred to herein as switches 105) among a first group of switches, and each nozzle sensor among the plurality of nozzle sensors of the second subset (nozzle sensors 111-2 and 111-R) may be electrically coupled to a second control line 109 by a respective switch 107-1, 107-P (collectively referred to herein as switches 107) among a second group of switches. In some examples, the first group of switches 105 may be of a different type than the second group of switches 107. For instance, the switches 105 may be N-type switches, whereas switches 107 may be P-type switches. That is, nozzle sensors 111-1 and 111-3 may be electrically coupled to control line 103 by P-type switches 105-1 and 105-N, respectively, and nozzle sensors 111-2 and 111-R may be electrically coupled to control line 109 by P-type switches 107-1 and 107-P, respectively. As used herein, an N-type switch refers to a device capable of amplifying and/or switching electronic signals using an N-type semiconductor. Examples of an N-type switch may include an N-type field-effect transistor (FET) and/or an N-type metal-oxide-semiconductor field-effect transistor (MOSFET). Examples are not so limited, however, and the plurality of nozzle sensors may be coupled to the control line in other ways. As used herein, a P-type switch refers to a device capable of amplifying and/or switching electronic signals using a P-type semiconductor. Examples of a P-type switch may include a P-type FET and/or a P-type MOSFET. Although switches 107 and 105 are illustrated as P-type switches and N-type switches, respectively, examples are not so limited. For example, switches 107 may be N-type switches and switches 105 may be P-type switches. In another example, switches 107 and 105 may be other types of switches, arranged such that an alternating bias is generated among nozzle sensors 111.

Referring again to FIG. 1A, each respective switch of the first group of switches 105 may include a first side electrically coupled to the respective nozzle sensor, and a second side electrically coupled to a low bias voltage. For example, a first side of switch 105-1 may be electrically coupled to nozzle sensor 111-1, and a second side of switch 105-1 may be electrically coupled to a low bias voltage, such as ground, or a 1V power supply, among other examples. A gate of switch 105-1 may be electrically coupled to control line 103. Similarly, each respective switch of the second group of switches 107 may include a first side electrically coupled to a supply voltage, and a second side electrically coupled to the respective nozzle sensor. For example, a first side, such as a gate, of switch 107-1 may be electrically coupled to a supply voltage via control line 109, while a second side of switch 107-1 may be electrically coupled to nozzle sensor 111-2. That is, the fluid ejection die 100 may include a gate of each respective switch of the first group of switches 105 electrically coupled to the first control line 103, and a gate of each respective switch of the second group of switches 107 electrically coupled to the second control line 109.

Fluid ejection die 100 may further include a control circuit 110 to perform a current leakage test of the plurality of nozzles using the first control line 103 and the second control line 109. As used herein, a control circuit refers to a circuit to generate an alternating bias among the plurality of nozzle sensors 111, using a plurality of control lines. That is, the control circuit 110 may create an alternating bias among the plurality of nozzle sensors using the first control line 103 and the second control line 109. The control circuit 110 may further perform a current leakage test by applying a high bias voltage to the first control line 103 and a low bias voltage to the second control line 109.

Figure 2:
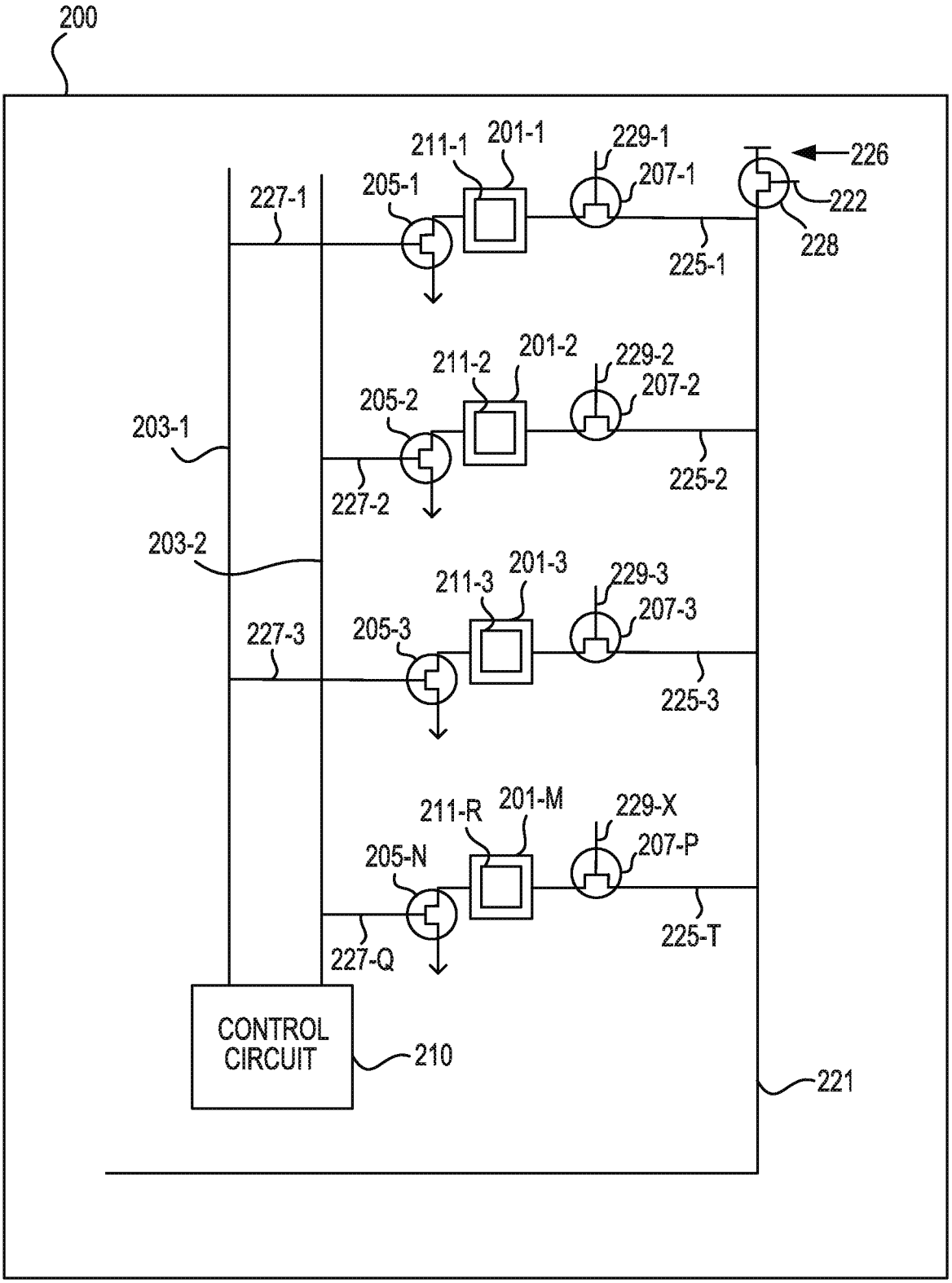
FIG. 2 further illustrates a diagram of an example fluid ejection die, according to the present disclosure.

FIG. 2 further illustrates a diagram of an example fluid ejection die 200, according to the present disclosure. The fluid ejection die 200 may be analogous to fluid ejection die 100 illustrated in FIG. 1A. As described in relation to FIG. 1A, the fluid ejection die 200 may include a plurality of nozzles 201, and each nozzle among the plurality of nozzles may include a nozzle sensor and a fluid ejector. Also, as discussed in relation to FIG. 1B, each nozzle sensor may be disposed proximal to a fluid chamber relative to the respective fluid ejector.

As illustrated in FIG. 2, the fluid ejection die 200 may include a plurality of pull-down lines 203-1, 203-1 (collectively referred to herein as pull-down lines 203), electrically coupled to the plurality of nozzle sensors. Each of the plurality of pull-down lines 203 may be electrically coupled to a subset of the plurality of nozzle sensors. For example, pull-down line 203-1 may be electrically coupled to nozzle sensors 211-1 and 211-3, while pull-down line 203-2 may be electrically coupled to nozzle sensors 211-2 and 211-R. Put another way, pull-down line 203-1 may be referred to as an "odd" pull-down line, and pull-down line 203-2 may be referred to as an "even" pull-down line. The odd pull-down line (e.g., 203-1) may be electrically coupled to "odd" numbered nozzle sensors. For instance, nozzle sensor 211-1 may be nozzle sensor address number 1, and nozzle sensor 211-3 may be nozzle sensor address number 3. In such a manner, the "odd" pull-down line (203-1) may be electrically coupled to the "odd" nozzle sensors. Similarly, the even pull-down line (e.g., 203-2) may be electrically coupled to "even" numbered nozzle sensors. For instance, nozzle sensor 211-2 may be nozzle sensor address number 2, and nozzle sensor 211-R may be nozzle sensor address number 4. In such a manner, the "even" pull-down line (203-2) may be electrically coupled to the "even" nozzle sensors. Put another way, each nozzles nozzle sensor may have a switch associated with it. Odd numbered nozzle sensors may have their switch controlled by one pull-down line, the odd pull-down line, while the even numbered nozzle sensors may have their switch controlled by another control line, an even pull-down line.

As illustrated in FIG. 2, each of the plurality of nozzle sensors 211 may be electrically coupled to a switch 205-1, 205-2, 205-3 . . . 205-N (collectively referred to as switches 205) connecting the respective nozzle sensor to a pull-down line 203-1 or pull-down line 203-2. When a respective switch 205 is activated by a respective control line 227-1, 227-2, 227-3 . . . 227-Q (collectively referred to as control lines 227), the associated nozzle sensor may be electrically coupled to a low voltage supply. For example, nozzle sensor 211-1 may be electrically coupled to pull-down line 203-1 by control line 227-1 and switch 205-1. nozzle sensor 211-2 may be electrically coupled to pull-down line 203-2 by control line 227-2 and switch 205-2. Nozzle sensor 211-3 may be electrically coupled to pull-down line 203-1 by control line 227-3 and switch 205-3. Nozzle sensor 211-R may be electrically coupled to pull-down line 203-2 by control line 227-Q and switch 205-N.

While pull-down line 203-1 is described herein as an "odd" pull-down line, and pull-down line 203-2 is described herein as an "even" pull-down line, such designations are for illustration purposes only. As such, pull-down line 203-1 may be referred to as an "even" control line, and control line 203-2 may be referred to as an "odd" control line. Similarly, the designation of "odd" and "even" of nozzle sensors may be reversed. That is, regardless of nomenclature, pull-down line 203-1 and pull-down line 203-2 may be electrically coupled to alternating nozzle sensors among the plurality of nozzle sensors 211 such that an alternating bias may be generated.

The fluid ejection die 200 may include a pull-up line 221. Each of the plurality of nozzle sensors 211 may be electrically coupled to the pull-up line 221 by a respective control line 225-1, 225-2, 225-3 . . . 225-T (collectively referred to as control lines 225) and switch 207-1, 207-2, 207-3 . . . 207-P (collectively referred to as switches 207). For example, nozzle sensor 211-1 may be electrically coupled to pull-up line 221 by control line 225-1 and switch 207-1. Nozzle sensor 211-2 may be electrically coupled to pull-up line 221 by control line 225-2 and switch 207-2. Nozzle sensor 211-3 may be electrically coupled to pull-up line 221 by control line 227-3 and switch 207-3. Nozzle sensor 211-R may be electrically coupled to pull-up line 221 by control line 227-T and switch 207-P. The pull-up line may apply a high bias voltage, relative to a threshold voltage, and a pull-down line may maintain a low bias voltage, relative to the threshold.

Furthermore, each of switches 207 may be individually activated by control lines 229-1, 229-2, 229-3 . . . 229-X (collectively referred to as control lines 229). That is, switch 207-1 may be activated (also referred to as "turned on") by control line 229-1. Switch 207-2 may be activated by control line 229-2. Switch 207-3 may be activated by control line 229-3, and switch 207-P may be activated by control line 229-X. While examples are provided herein of activating a single control line 229 at a time, examples are not so limited and multiple control lines 229 may be activated at a time. As such, multiple switches 207 may be activated at a time.

As described herein, a current leakage test of the fluid ejection die 200 may be performed. To perform a current leakage test, a switch among the plurality of switches 207 may be activated by the respective control line 229. For instance, switch 207-1 may be activated by a signal sent to control line 229-1. In this particular example, switches 207-2, 207-3, and 207-P may remain in an off position. Put another way, to test for current leakage between nozzles 211-1 and 211-2, switch 207-1 may be turned on. Next, and/or concurrently, a switch 228 may be activated by a test signal 222, which may connect pull-up line 221 to a high voltage supply 226. In such a manner, a high bias voltage may be applied to a particular nozzle sensor (e.g., 211-1) among the plurality of nozzle sensors 211 responsive to activation of a switch electrically coupling the particular nozzle sensor to the pull-up line 221.

In another example, to perform a current leakage test of a particular nozzle sensor, for instance, nozzle sensor 211-2, switch 207-2 may be activated by control line 229-2, and switches 207-1, 207-3, and 207-P may remain off. Next, and/or concurrently, a switch 228 may be activated by a test signal, which may connect pull-up line 221 to a high voltage supply 226. In such a manner, switch 207-2 may connect control line 225-2 to pull-up line 221. In another example, to perform a current leakage test of nozzle sensor 211-3, switch 207-3 may be activated by control line 229-3, and so forth.

As described herein, pull-up line 221 may provide a high bias voltage to the plurality of nozzle sensors 211, whereas pull-down lines 203 may provide a low bias voltage to the plurality of nozzle sensors 211. Moreover, by alternatively coupling pull-down line 203-1 and pull-down line 203-2, an alternating bias may be generated among the plurality of nozzle sensors 211. For instance, a first low bias voltage line, such as pull-down line 203-1 may be electrically coupled to a first subset of the plurality of nozzle sensors, such as nozzle sensors 211-1 and 211-3. When pull-down line 203-1 is activated, nozzle sensors 211-1 and 211-3 may maintain a low bias voltage. A second low bias voltage line, such as pull-down line 203-2, may be electrically coupled to a second subset of the plurality of nozzle sensors, such as nozzle sensors 211-2 and 211-R. When pull-down line 203-2 is activated, nozzle sensors 211-2 and 211-R may maintain a low bias voltage.

As described herein, fluid ejection die 200 may perform a current leakage test of the plurality of nozzle sensors 211 responsive to maintenance of a low bias voltage using a pull-down line and application of a high bias voltage using a pull-up line. As used herein, maintenance of a low bias voltage may refer to application of a low voltage, such as 1 volt (1V) or 2V, and/or maintenance of a low bias voltage may refer to grounding. The current leakage test may be performed responsive to application of a test voltage to a particular nozzle sensor among the plurality of nozzle sensors 211 and application of a low bias voltage of a different nozzle sensor among the plurality of nozzle sensors, where the different nozzle sensor is adjacent to the particular nozzle sensor. For example, a current leakage test of nozzle sensor 211-1 may be performed by maintaining a low voltage bias on nozzle sensors 211-2 and 211-R using pull-down line 203-2, applying a high voltage bias to nozzle sensor 211-1 by activating switch 207-1, and applying a high voltage to pull-up line 221. A current leakage, in the form of sensor to sensor leakage, may be detected as current flows from 226, through switch 228, through switch 207-1 and nozzle sensor 211-1 leaking to nozzle sensor 211-2, through switch 205-2 (which was activated by pull-down line 203-2) and to a low voltage supply. This leak in current between nozzle sensors 211-1 and 211-2 may be detected as an elevated current drawn by the entire fluid ejection die 200.

In another example, fluid ejection die 200 may perform a current leakage test of nozzle sensor 211-2. In such an example, a low voltage bias may be maintained on nozzle sensors 211-2 and 211-3 using pull-down line 203-1. A high voltage bias may be applied to nozzle sensor 211-2 by activating switch 207-2, and applying a high voltage to pull-up line 221. A current leakage, in the form of sensor to sensor leakage, may be detected as current flows from 226, through switch 228, through switch 207-2 and nozzle sensor 211-2, leaking to nozzle sensor 211-3, through switch 205-3 (which was activated by pull-down line 203-1) and to a low voltage supply. Again, this leak in current between nozzle sensors 211-2 and 211-3 may be detected as an elevated current drawn by the entire fluid ejection die 200.

In yet another example, a plurality of nozzle sensors may be tested at a time. For example, a current leakage test may be performed for a subset of nozzle sensors, such as nozzle sensors 211-1 and 211-3, at a same time. In such an example, a low bias voltage may be maintained on the subset of nozzle sensors (nozzle sensors 211-2 and 211-R) by activating pull-down line 203-2. Switches 207-1 and 207-3 may both be activated via control lines 229-1 and 229-3, respectively. Switch 228 may be turned on, and a high bias voltage may be applied to both nozzle sensors 211-1 and 211-3, while a low bias voltage may be maintained on nozzle sensors 211-2 and 211-R. Again, a leak in current, between any one of nozzle sensors 211, may be detected as an elevated current drawn by the entire fluid ejection die 200.

Figure 3:
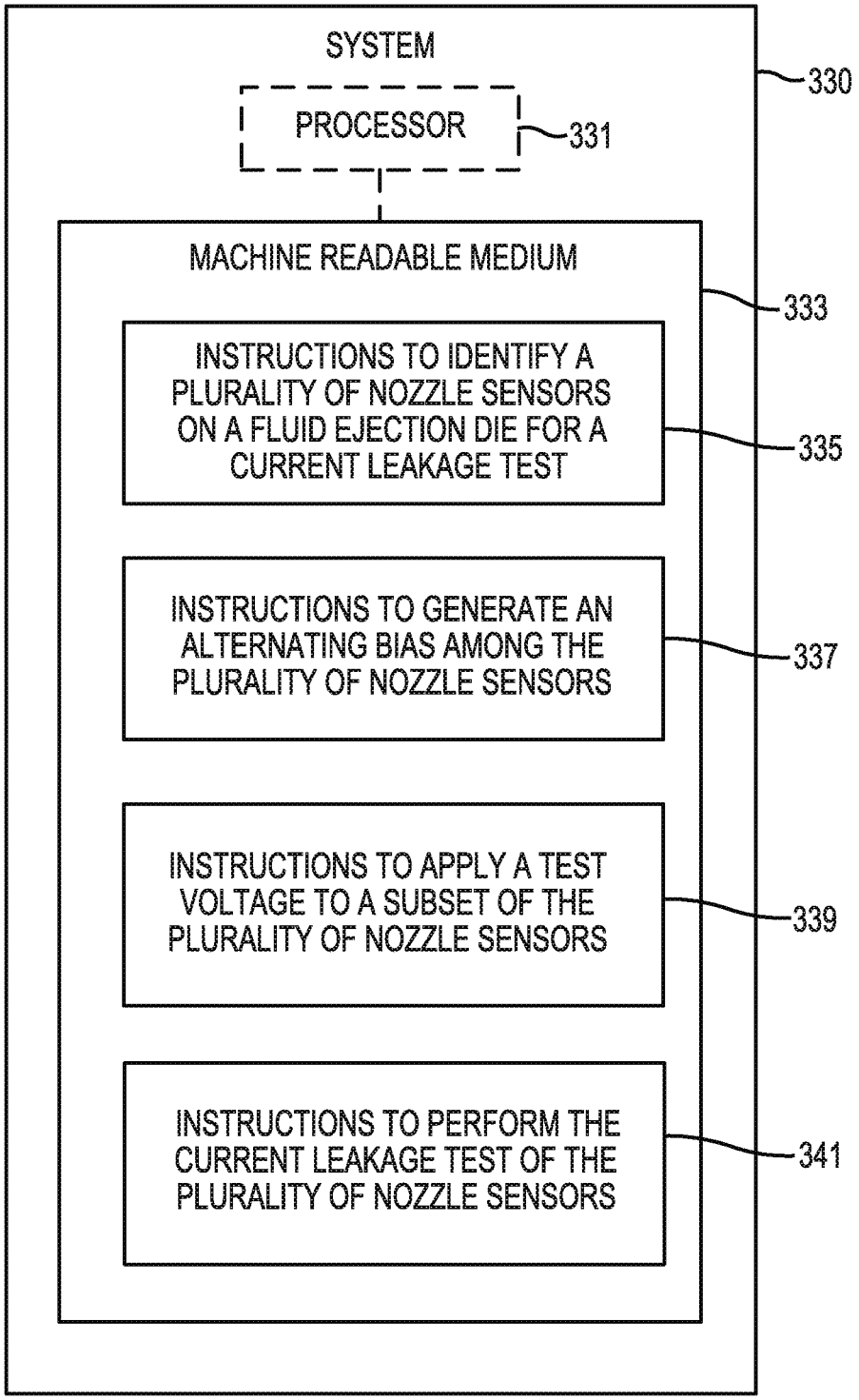
FIG. 3 is a block diagram of an example system, according to the present disclosure.

FIG. 3 is a block diagram of an example system 330, according to the present disclosure. System 330 may include at least one computing device that is capable of communicating with at least one remote system. In the example of FIG. 3, system 330 includes a processor 331 and a machine readable medium 333. Although the following descriptions refer to a single processor and a single machine readable medium, the descriptions may also apply to a system with multiple processors and machine readable mediums. In such examples, the instructions may be distributed (e.g., stored) across multiple machine readable mediums and the instructions may be distributed (e.g., executed by) across multiple processors.

Processor 331 may be a central processing unit (CPU), microprocessor, and/or other hardware device suitable for retrieval and execution of instructions stored in machine readable medium 333. In the particular example shown in FIG. 3, processor 331 may receive, determine, and send instructions 335, 337, 339, and 341 for current leakage testing of a fluid ejection die. As an alternative or in addition to retrieving and executing instructions, processor 331 may include an electronic circuit comprising a number of electronic components for performing the functionality of the instructions in machine readable medium 333. With respect to the executable instruction representations (e.g., boxes) described and shown herein, it should be understood that part or all of the executable instructions and/or electronic circuits included within one box may, in alternate embodiments, be included in a different box shown in the figures or in a different box not shown.

Machine readable medium 333 may be any electronic, magnetic, optical, or other physical storage device that stores executable instructions. Thus, machine readable medium 333 may be, for example, Random Access Memory (RAM), an Electrically-Erasable Programmable Read-Only Memory (EEPROM), a storage drive, an optical disc, and the like. Machine readable medium 333 may be disposed within system 330, as shown in FIG. 3. In this situation, the executable instructions may be "installed" on the system 330. Additionally and/or alternatively, machine readable medium 333 may be a portable, external or remote storage medium, for example, that allows system 330 to download the instructions from the portable/external/remote storage medium. In this situation, the executable instructions may be part of an "installation package". As described herein, machine readable medium 333 may be encoded with executable instructions for low voltage bias of nozzle sensors.

Referring to FIG. 3, the instructions 335, when executed by a processor (e.g., 331), may cause system 330 to identify a plurality of nozzles on a fluid ejection die for a current leakage test. Referring to FIGS. 1 and 2, all, or a subset of nozzles and associated nozzle sensors may be selected for current leakage testing. That is, a single nozzle may be addressed one at a time and a leakage may be isolated. In other examples, current leakage testing may be performed on a column of nozzles (and associated nozzle sensors). If a current leakage is detected in the column, the current leakage test may be performed on a primitive of nozzles (and associated nozzle sensors). As used herein, a primitive refers to a group of nozzles, where a plurality of primitives comprise a column. Moreover, if a current leakage is detected in a primitive, the exact location of the leakage may be identified by addressing each nozzle (and associated nozzle sensor) in that particular primitive.

The instructions 337, when executed by a processor (e.g., 331), may cause system 330 to generate an alternating bias among the plurality of nozzles using a pull-down line and a pull-up line. That is, during a leakage detection test, a low voltage bias line such as pull-down line 203-1 or 203-2 may be activated, and a high voltage bias line, such as pull-up line 221 may be activated.

The instructions 339, when executed by a processor (e.g., 331), may cause system 330 to apply a test voltage (also referred to as a high bias voltage) to a subset of the plurality of nozzles using the pull-up line and low bias voltage applied to a remainder of the plurality of nozzles using a pull-down line. The instructions 341, when executed by a processor (e.g., 331), may cause system 330 to perform the current leakage test of the plurality of nozzles responsive to application of the test voltage and the low bias voltage to the remainder of the plurality of nozzles.

In some examples, the machine readable medium may include instructions that, when executed by a processor (e.g., 331), may cause system 330 to identify a column of nozzles among the plurality of nozzles for the current leakage test, apply the test voltage to a subset of the column of nozzles using the pull-up line and a low bias voltage to a remainder of the column using a pull-down line.

In some examples, the machine readable medium may include instructions that, when executed by a processor (e.g., 331), may cause system 330 to identify a particular nozzle among the plurality of nozzles for a subsequent current leakage test responsive to detection of a current leakage during the current leakage test. That is, a column of nozzles on a fluid ejection die may indicate a current leakage, in the form of a nozzle to nozzle (or more particularly, sensor to sensor) leak. A subsequent current leakage test may be performed to identify a particular nozzle sensor that is leaking current. In such an example, a test voltage may be applied to the particular nozzle (and associated nozzle sensor) using the pull-up line and a low bias voltage may be applied to an adjacent nozzle (and associated nozzle sensor) using the pull-down line.

Figure 4:
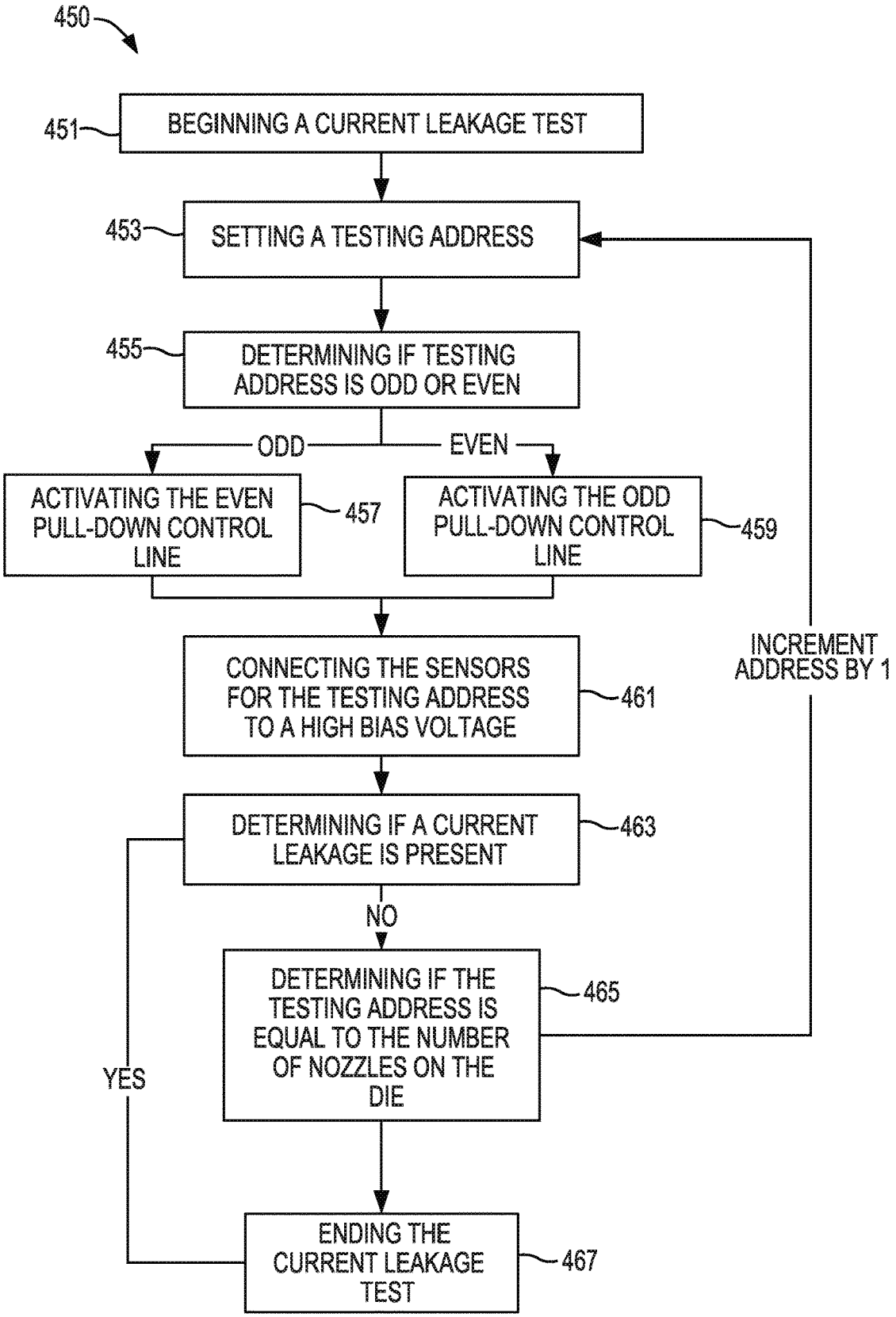
FIG. 4 further illustrates an example method according to the present disclosure.

FIG. 4 further illustrates an example method 450 according to the present disclosure. At 451, the method 450 may include beginning a current leakage test. At 453, the method 450 may include setting a testing address. For example, as described in relation to FIG. 2, a particular address associated with a particular nozzle sensor may be selected, such that the switch connecting the particular nozzle sensor to the pull-up line is turned on. At 455, the method 450 may include determining if the testing address is odd or even. As used herein, the testing address refers to the address of the nozzle sensor to be tested. If the testing address is odd, the method 450 may include activating the even pull-down line at 457. That is, the even numbered nozzle sensors may be biased low. Similarly, if the testing address is even, the method 450 may include activating the odd pull-down line at 459. That is, the odd numbered nozzle sensors may be biased low. At 461, the method 450 may include connecting the nozzle sensors for the testing address to a high bias voltage. That is, the nozzle sensor for the nozzle assigned to the address being tested may be electrically connected to the pull-up line (e.g., 221 illustrated in FIG. 2). At 463, the method 450 may include determining if a current leak is present. If a current leakage is detected, the method 450 may proceed to 467 with ending the current leakage test. If a current leakage is not detected, the method 450 proceeds to determining if the testing address is equal to the number of nozzles on the die at 465. That is, if 8 nozzles are on the fluid ejection die, a determination may be made as to whether the last testing address was address 8. If the testing address is not equal to the number of nozzles on the die, the address is incremented by 1 and the method 450 repeats from 453. Similarly, if the testing address is equal to the number of nozzles on the die at 465, the method 450 may proceed to 467 with ending of the current leakage test.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, the designator "M" "N", "P", "R", and "T" particularly with respect to reference numerals in the drawings, indicates that a number of the particular feature so designated can be included with examples of the present disclosure. The designators can represent the same or different numbers of the particular features.

What is claimed:

1. A fluid ejection die, comprising:

a plurality of nozzles, each nozzle among the plurality of nozzles including a nozzle sensor and a fluid ejector;

the plurality of nozzle sensors comprising a first subset and a second subset, each nozzle sensor among the plurality of nozzle sensors of the first subset electrically coupled to a first control line by a respective switch among a first group of switches, and each nozzle sensor among the plurality of nozzle sensors of the second subset electrically coupled to a second control line by a respective switch among a second group of switches; and a control circuit to perform a current leakage test of the plurality of nozzles using the first control line and the second control line.

2. The fluid ejection die of claim 1, the control circuit to create an alternating bias among the plurality of nozzle sensors using the first control line and the second control line.

3. The fluid ejection die of claim 1, each respective switch of the first group of switches including a first side electrically coupled to the respective nozzle sensor, and a second side electrically coupled to a low bias voltage.

4. The fluid ejection die of claim 1, each respective switch of the second group of switches including a first side electrically coupled to a supply voltage, and a second side electrically coupled to the respective nozzle sensor.

5. The fluid ejection die of claim 1, including a gate of each respective switch of the first group of switches electrically coupled to the first control line, and a gate of each respective switch of the second group of switches electrically coupled to the second control line.

6. The fluid ejection die of claim 1, the control circuit to perform the current leakage test by applying a high bias voltage to the first control line and a low bias voltage to the second control line.

7. A fluid ejection die, comprising:

a plurality of nozzles, each nozzle including a nozzle sensor and a fluid ejector, each nozzle sensor disposed proximal to a fluid chamber relative to the respective fluid ejector;

a pull-down line electrically coupled to the plurality of nozzle sensors;

a pull-up line electrically coupled to the plurality of nozzle sensors by a different respective switch;

the fluid ejection die to perform a current leakage test of the plurality of nozzle sensors responsive to maintenance of a low bias voltage using the pull-down line and application of a high bias voltage using the pull-up line.

8. The fluid ejection die of claim 7, wherein the fluid ejection die to perform the current leakage test includes the fluid ejection die to:

maintain a low bias voltage on a subset of the plurality of nozzle sensors using the pull-down line; and application of a high bias voltage on a remainder of the plurality of nozzle sensors using the pull-up line.

9. The fluid ejection die of claim 7, the fluid ejection die including an odd pull-down line electrically coupled to odd nozzle sensors among the plurality of nozzle sensors and an even pull-down line electrically coupled to even nozzle sensors among the plurality of nozzle sensors.

10. The fluid ejection die of claim 9, the fluid ejection die to perform the current leakage test responsive to application of a low bias voltage to the even nozzle sensors using the even pull-down line and application of a high bias voltage to the odd nozzle sensors using the pull-up line.

11. The fluid ejection die of claim 7, the fluid ejection die to perform the current leakage test responsive to application of a high bias voltage to a particular nozzle sensor among the plurality of nozzle sensors and low bias voltage of a different nozzle sensor among the plurality of nozzle sensors, the different nozzle sensor adjacent to the particular nozzle sensor.

12. The fluid ejection die of claim 7, wherein the fluid ejection die to perform the current leakage test includes the fluid ejection die to provide a test voltage to a particular nozzle sensor among the plurality of nozzle sensors, using a control line electrically coupled to the particular nozzle sensor.

13. A non-transitory machine readable medium storing instructions executable by a processor, causing the processor to:

identify a plurality of nozzle sensors on a fluid ejection die for a current leakage test;

generate an alternating bias among the plurality of nozzle sensors using a pull-down line and a pull-up line;

apply a test voltage to a subset of the plurality of nozzle sensors using the pull-up line and maintain a low bias voltage on a remainder of the plurality of nozzle sensors using the pull-down line; and perform the current leakage test of the plurality of nozzle sensors responsive to application of the test voltage and the low bias voltage of the remainder of the plurality of nozzle sensors.

14. The non-transitory machine readable medium of claim 13, including instructions to:

identify a column of nozzle sensors among the plurality of nozzle sensors for the current leakage test; and apply the test voltage to a subset of the column of nozzle sensors using the pull-up line and low bias voltage of a remainder of the column using the pull-down line.

15. The non-transitory machine readable medium of claim 13, including instructions to:

identify a particular nozzle sensor among the plurality of nozzle sensors for a subsequent current leakage test; and apply a test voltage to the particular nozzle sensor using the pull-up line and low bias voltage an adjacent nozzle sensor using the control line.

* * * * *